US007908727B2

(12) United States Patent
Clew

(10) Patent No.: US 7,908,727 B2
(45) Date of Patent: Mar. 22, 2011

(54) FASTENER INSERTION APPARATUS AND METHOD

(75) Inventor: Nicholas Richard Clew, Farmington Hills, MI (US)

(73) Assignee: Henrob Limited (GB)

( * ) Notice: Subject to any disclaimer, the term of this patent is extended or adjusted under 35 U.S.C. 154(b) by 0 days.

(21) Appl. No.: 12/502,711

(22) Filed: Jul. 14, 2009

(65) Prior Publication Data

US 2009/0320272 A1 Dec. 31, 2009

Related U.S. Application Data

(60) Division of application No. 11/225,421, filed on Sep. 13, 2005, now Pat. No. 7,673,377, which is a continuation of application No. 10/138,679, filed on May 3, 2002, now Pat. No. 6,951,052.

(30) Foreign Application Priority Data

May 5, 2001 (GB) ..... 0111265.5

(51) Int. Cl.
*B23Q 17/00* (2006.01)
*B23P 21/00* (2006.01)
*B23Q 15/00* (2006.01)

(52) U.S. Cl. ..... 29/407.1; 29/407.03; 29/407.05; 29/407.08; 29/407.02; 29/525.06; 29/524.1; 29/525.01; 29/715; 29/716; 29/798; 29/509

(58) Field of Classification Search ..... 29/407.01, 29/407.02, 524.1, 525.01, 525.06, 407.08, 29/407.05, 432.1, 709, 715, 716, 720, 798, 29/243.53, 432, 407.03, 407.04, 407.1, 505, 29/509, 514

See application file for complete search history.

(56) References Cited

U.S. PATENT DOCUMENTS

| | | | | | |
|---|---|---|---|---|---|
| 1,483,919 | A * | 2/1924 | Walker | 72/29.2 |
| 4,615,475 | A * | 10/1986 | Fuhrmeister | 227/136 |
| 5,138,758 | A * | 8/1992 | Gubbiotti et al. | 29/432.2 |
| 5,471,865 | A * | 12/1995 | Michalewski et al. | 72/430 |
| 5,491,372 | A * | 2/1996 | Erhart | 310/80 |
| 5,557,154 | A * | 9/1996 | Erhart | 310/80 |
| 5,752,305 | A * | 5/1998 | Cotterill et al. | 29/432.2 |
| 5,829,115 | A * | 11/1998 | Speller et al. | 29/525.06 |
| 5,957,362 | A * | 9/1999 | Samulowitz et al. | 227/2 |
| 6,058,598 | A * | 5/2000 | Dixon et al. | 29/714 |
| 6,276,050 | B1 * | 8/2001 | Mauer et al. | 29/716 |
| 6,357,100 | B2 * | 3/2002 | Speller et al. | 29/407.09 |
| 6,502,008 | B2 * | 12/2002 | Maurer et al. | 700/175 |
| 6,543,121 | B2 * | 4/2003 | Speller et al. | 29/525.06 |
| 6,676,000 | B2 * | 1/2004 | Lang et al. | 227/51 |
| 6,789,309 | B2 * | 9/2004 | Kondo | 29/709 |

(Continued)

*Primary Examiner* — Essama Omgba
(74) *Attorney, Agent, or Firm* — Jennifer E. Lacroix, Esq.; DLA Piper LLP (US)

(57) ABSTRACT

A rivet is inserted into a workpiece by an apparatus that includes an internal roller screw linear actuator in which rotational movement of an internally threaded cylinder is converted into linear movement of a fastener insertion actuator assembly. The cylinder is driven in rotation by a servo-controlled motor. The angular velocity of the cylinder required to deliver the required energy to effect fastener insertion is calculated and the motor is first controlled to accelerate the cylinder up to the calculated angular velocity, the actuator assembly simultaneously being moved by the cylinder towards the workpiece. The motor is then controlled to maintain the angular velocity of the cylinder at not less than the calculated magnitude at least until insertion of the fastener. The cylinder stores kinetic energy by virtue of its inertia. Using this inertia to insert fasteners eliminates the need for position or force feedback control. The process allows for a rapid cycle time and the apparatus is compact.

3 Claims, 2 Drawing Sheets

U.S. PATENT DOCUMENTS 6,942,134 B2 * 9/2005 Naito ..... 227/51
6,951,052 B2 * 10/2005 Clew ..... 29/525.06
7,024,270 B2 * 4/2006 Mauer et al. ..... 700/175
7,032,296 B2 * 4/2006 Zdravkovic et al. ..... 29/709
7,123,982 B2 * 10/2006 Mauer et al. ..... 700/175
7,409,760 B2 * 8/2008 Mauer et al. ..... 29/715
7,673,377 B2 * 3/2010 Clew ..... 29/407.1
2001/0027597 A1 * 10/2001 Mauer et al. ..... 29/407.04
2002/0144386 A1 * 10/2002 Lang et al. ..... 29/243.53
2004/0111878 A1 * 6/2004 Naito ..... 29/798
2006/0207079 A1 * 9/2006 Mauer et al. ..... 29/243.53
2007/0180674 A1 * 8/2007 Morden et al. ..... 29/407.01

* cited by examiner

FASTENER INSERTION APPARATUS AND METHOD

CROSS REFERENCE TO RELATED APPLICATION

This application is a divisional of U.S. application Ser. No. 11/225,421, filed Sep. 13, 2005, which issued on Mar. 9, 2010 as U.S. Pat. No. 7,673,377, and which is a continuation of U.S. application Ser. No. 10/138,679, filed May 3, 2002, which issued on Oct. 4, 2005 as U.S. Pat. No. 6,951,052.

The present invention relates to fastener insertion and more particularly to a method and apparatus for inserting fasteners into a workpiece (e.g. sheet material) without the workpiece being pre-drilled or punched. It may be used, for example, in self-piercing riveting whereby a rivet is inserted into a workpiece without full penetration such that the deformed end of the rivet remains encapsulated by an upset annulus of the sheet material, or in clinching. The term "clinching" is also known as "press-joining" or "integral fastening".

Methods and machines for self-piercing riveting are described in U.S. Pat. No. 4,615,475 (Nietek Pty. Ltd.) and U.S. Pat. No. 5,752,305 (Henrob Ltd.). The latter document describes a hydraulically operated riveting machine in which a pump supplies pressurised hydraulic fluid to a main hydraulic cylinder. A workpiece (usually two or more sheets of material to be joined) is supported under the riveting machine on a die. The hydraulic fluid drives a plunger longitudinally in the main cylinder so as to advance a clamping cylinder and bring it into contact with the workpiece to be riveted so that it is held against the die. The pressure of the hydraulic fluid is increased so that the clamping cylinder applies a predetermined clamping force to the workpiece. The plunger then drives a punch longitudinally inside the clamping cylinder so that it is advanced towards a pre-loaded rivet. Once engaged with the rivet, the punch is advanced further so as to drive it into the workpiece. The rivet penetrates the top surface of the workpiece and during insertion its shank deforms in the workpiece material. In the case where the workpiece is sheet material the deformed rivet penetrates the upper sheets but not the lower sheet and is encapsulated within an upset annulus of the sheet material.

Methods and apparatus for clinching are described in our European patent no. 0614405.

Self-piercing riveting requires very accurate control of the force or energy applied during insertion of the rivet. In the hydraulic system referred to above the insertion force is controlled using pressure relief valves that are configured to limit the hydraulic pressure applied to the punch. Such valves are prone to variations in performance as a result of wear or temperature variation and therefore have to be regularly checked and re-calibrated. In general, hydraulic rivet setters are difficult to control as effectively or efficiently as other types of rivets setters.

It is also known to use electric rivet setters in which the rotary motion of a servomotor is translated into longitudinal movement of a plunger and/or a clamping device. European patent application no. EP 0893172 (Emhart) describes one such rivet setter in which an electric motor drive unit is connected to a transmission unit which in turn drives a plunger and a clamping device.

The use of roller screws in linear actuators to convert rotary motion into longitudinal movement is well documented. They usually take one of two forms: external or internal roller screws. An external roller screw has a central elongate screw member that is connected to a concentric outer nut via threaded roller elements. The nut is restrained from rotational movement so that rotation of the central screw results in linear movement of the nut. An internal roller screw has a rotating hollow cylinder that is internally threaded and an externally grooved output shaft that is received at least in part in the bore of the cylinder and is engaged by the output shaft threaded roller transmission elements. The output shaft is restrained from rotational motion so that rotation of the cylinder results in linear movement of the shaft. Examples of internal roller screws are described in U.S. Pat. Nos. 5,491,372 and 5,557,154. These types of roller screws have not been used in industry to any significant extent as they are expensive to manufacture in comparison to an external roller screw and offer little or no advantages in terms of performance and load capacity.

Linear actuators of the kind described above tend to be bulky. If they were to be used in rivet setters it would be necessary to have a motor of around 5 horse power to achieve the same level of performance, force and speed as a hydraulic rivet setter. A smaller motor can be used with a reduction gearbox but this results in a slower rivet insertion cycle time.

U.S. Pat. No. 5,557,154 (Exlar Corporation) describes an electrically powered linear actuator. An output shaft of the actuator is moved between retracted and extended positions by an electric motor and transmission rollers. A stator coil of the motor is selectively energised so as to rotate an armature in the form of an elongate cylinder of magnetic material. The transmission rollers engage with a thread on the inside of the cylinder and with annular rings at one end of the output shaft. Under the control of a positional feedback circuit the motor rotates the armature so as to retract or extend the output shaft a predetermined distance.

Electric rivet setters typically use load sensing transducers to monitor the load and indicate when the desired force has been reached. Alternatively electric motor current monitoring or limiting is used. Such sensing devices can be unreliable as the rivet setting actuator has to travel slowly enough to prevent the actuator overshooting during the time taken between detecting the desired force and turning off the drive power. Without accurate control of the actuator travel distance the rivet insertion depth varies from cycle to cycle and results in riveted joints of unpredictable and varying quality.

It is known to use the energy stored in a spinning inertia flywheel to drive an electric rivet setter. The inertia of a flywheel allows energy to be stored over a period of time prior to rivet insertion. The energy is then used to insert the rivet in a short space of time. Traditionally such rivet setters have one or two large flywheels that are maintained at a constant angular velocity by an electric motor. When it is desired to insert a rivet into a workpiece a clutch is used to connect the flywheel to a punch and a proportion of the energy stored in the flywheel is transferred into linear movement of the punch as it advances and inserts the rivet. The flywheel is oversized in relation to the energy required to insert a rivet and the arrangement is inefficient. Typically only around 10% of the flywheel energy is needed to drive the punch. Once the rivet insertion cycle is complete the clutch disengages from the flywheel and the motor is used to restore its original angular velocity. The insertion force applied by such rivet setters is difficult to control accurately and does not take account of such factors as the reaction forces encountered by the rivet during insertion.

One example of a flywheel driven device for inserting fasteners, such as rivets, is described in UK 1487098. A ram for inserting fasteners is driven longitudinally in a housing between extended and retracted positions by a pair of flywheels. A pair of electric motors drive the flywheels in rotation until they reach a predetermined speed. When it is required to insert a fastener a clutch mechanism brings the periphery of the flywheels into frictional contact with the ram so as to accelerate it longitudinally. A travel limit stop prevents the ram from extending too far from the housing. Again this device is bulky as a result of the large size of the flywheels and the motor.

Many hydraulic and electrical rivet setters have an internal stop to limit the travel of the punch to a point where it is substantially flush with the nose of the setter. However, tests performed by the inventors have established that significant reductions in the riveted joint fatigue properties result from using such stops. The best quality of riveted joint is accomplished when the rivet insertion force and the clamping force applied by the nose are independently controlled and not linked via an internal stop at the conclusion of the rivet insertion It is an object of the present invention to obviate or mitigate the aforesaid disadvantages.

According to a first aspect of the present invention there is provided a method for insertion of a fastener into a workpiece in which rotational movement of a longitudinally extending screw member is converted into linear movement of a fastener insertion actuator assembly by intermediate rolling transmission elements, the screw member being driven in rotation by a drive member, the method comprising the steps of:

(a) determining the energy required to insert the fastener into the workpiece;

(b) determining the angular velocity of the screw member required to deliver said energy to the fastener insertion actuator assembly;

(c) positioning a fastener for insertion;

(d) controlling the drive member so as to accelerate the screw member up to the determined angular velocity, the actuator assembly simultaneously being moved by the screw member towards the workpiece;

(e) thereafter controlling the drive member so as to maintain the angular velocity of the screw member substantially at not less than the determined magnitude at least until insertion of the fastener;

(f) bringing the actuator assembly into contact with the fastener so as to transfer the energy of the rotating screw member into work done in inserting the fastener into the workpiece.

This method makes use of the ability of the screw member to store significant amounts of kinetic energy by virtue of its inertia, in the manner of a flywheel. Using this inertia to insert fasteners eliminates the need for careful closed-loop feedback control by reference to the position of the actuator assembly or the force it applies. The energy required to make the fastened joint is determined before the fastener insertion operation commences and the screw member is rotated at the determined angular velocity to deliver the energy to the rivet insertion process taking into account any losses between the screw member rotation and the linear movement of the actuator assembly. There are therefore no restrictions on the cycle time of the fastening process enforced by position or force monitoring. The use of the screw member in this way eliminates the need for separate bulky flywheels and large capacity drives. The insertion apparatus is therefore relatively small and compact. Furthermore, since the actuator assembly is brought to rest when the energy transferred from the screw member has been converted into work done in inserting the rivet there is no requirement for actuator travel limit stops.

The drive member is ideally a motor with a servo-controller, the angular velocity of an output shaft of the motor being sensed during use. Encoder devices that are used to detect angular velocity are more stable than force or positional sensors thereby eliminating the need for regular re-calibration. The angular velocity of the output shaft of the motor required to drive the screw member at the determined angular velocity is determined by taking into account the transmission ratio and efficiency between the drive member and the screw member.

The angular velocity may be determined from the polar moment of inertia of the screw member and other parts that rotate therewith, the screw member having been selected to have a moment of inertia within a certain range determined by the energy required for insertion of the fastener and the capacity of the motor.

The angular velocity of the screw member may be maintained by the drive member at a value exceeding the determined value and the drive member used as a brake prior to or during rivet insertion to ensure that the determined amount of energy is delivered as work into the fastened joint. The motor may be operated ill reverse as a generator to achieve this. The electricity generated from the braking process may be stored in a capacitor or the like for future use by the motor. The same regenerative braking process may be used when retracting the actuator assembly after the fastener has been inserted.

The angular velocity of the screw member required to deliver said energy is preferably also determined by reference to the thread pitch of the screw member, the required stroke length of the actuator assembly to reach the fastener and the length of the fastener as well as the mass moment of inertia of the screw member. These parameters may therefore also be supplied to the control system so as to ensure that the screw member may be accelerated to have the required kinetic energy before the actuator assembly is brought into contact with the fastener. The velocity may also be calculated with reference to the spring rate of a frame that is used to support the workpiece being fastened. The spring rate of the frame determines the extent to which it deflects away from the actuator assembly during insertion of the fastener.

The actuator assembly may be designed to provide a clamping force to the workpiece prior to, during, and/or after rivet insertion.

According to a second aspect of the present invention there is provided fastener insertion apparatus for insertion of a fastener into a workpiece, comprising a longitudinally extending screw member that is rotatable about an axis by a drive member, a fastener insertion actuator assembly at least part of which is adjacent to the screw member and is connected to a thread thereof by intermediate rolling transmission elements such that rotation of the screw member is converted into linear movement of the actuator, a control system comprising a servo-controller for controlling operation of the drive member and therefore rotation of the screw member and a processor being configured to determine the angular velocity of rotation of the screw member required to deliver a predetermined amount of energy to the rivet insertion actuator assembly so as to insert the fastener and to instruct the servo-controller to operate the drive means so as to accelerate the screw member up to the determined angular velocity, the actuator assembly simultaneously being moved by the screw member towards the workpiece, the determined angular velocity of the screw member being maintained substantially at not less than the determined magnitude at least until insertion of the fastener.

The drive member is ideally a motor with a servo-controller and a velocity sensor for measuring the angular velocity of an output shaft of the motor. This may take the form of a rotational sensor for measuring the angular position with means for determining the angular velocity from the rate of change of position.

The motor is preferably operable as a regenerative brake to reduce the angular velocity of the screw member should it exceed the determined value and may be provided with an electrical storage device for storing electrical energy when it is operated as a generator.

The actuator assembly preferably comprises an output shaft forming a linear actuator with the screw member and the transmission elements, and a plunger for fastener insertion.

The plunger is preferably prevented from rotation by means of a linear bearing that may comprise a key attached to the plunger that is slidable within a keyway of a housing in which the plunger is disposed.

The output shaft of the actuator assembly is preferably connected to the plunger by means of a clutch device that is operable to disconnect the output shaft from the plunger when the torque in the output shaft is above a predetermined magnitude. This arrangement disconnects the drive member from the plunger and prevents the torque being transmitted to the linear bearing.

The clutch device may comprise a coupling with a frangible connection between the output shaft and the plunger. The frangible connection is preferably a shear pin that is designed to fail in shear at said predetermined torque magnitude. The coupling preferably comprises a coupling member with substantially coaxial sockets for receipt of the output shaft and the plunger, the member being connected to the output shaft by the shear pin, the pin being received in transverse apertures in the coupling member and the output shaft.

The apparatus is preferably provided with a clamping device that is driven by the actuator assembly to provide a clamping force to the workpiece prior to, during, and/or after rivet insertion.

The screw member may be part of an internal or external roller screw linear actuator but in a preferred embodiment it comprises a cylinder with an internally threaded bore in which at least part of the fastener insertion actuator assembly is received.

According to a third aspect of the present invention there is provided a panel clinching method wherein two or more sheets of material are deformed into locking engagement, the sheet material being disposed between a nose and a die of fastening apparatus, in which rotational movement of a longitudinally extending screw member is converted into linear movement of an actuator assembly by intermediate rolling transmission elements, the screw member being driven in rotation by a drive member, the method comprising the steps of:

(a) determining the energy required to deform the material;

(b) determining the angular velocity of the screw member required to deliver said energy to the actuator assembly;

(c) controlling the drive member so as to accelerate the screw member up to the determined angular velocity, the actuator assembly simultaneously being moved by the screw member towards the material;

(d) thereafter controlling the drive member so as to maintain the angular velocity of the screw member substantially at not less than the determined magnitude at least until deformation of the material;

(e) bringing the actuator assembly into contact with the material so as to transfer the energy of the rotating screw member into work done in deforming the material.

A specific embodiment of the present invention will now be described, by way of example only, with reference to the accompanying drawings in which.

Figure 1:
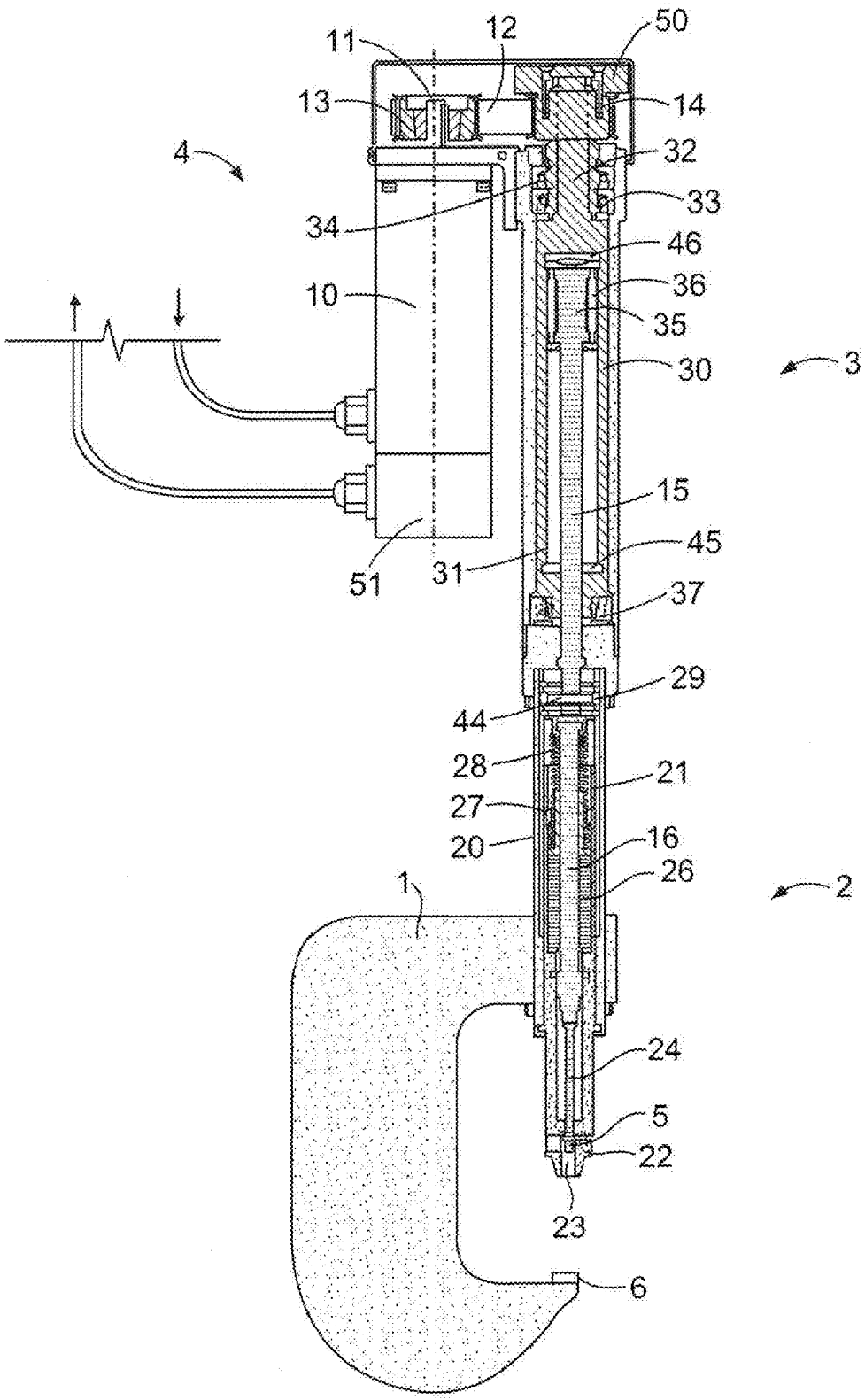
FIG. 1 is a longitudinal sectioned view through fastener setting apparatus of the present invention.

Referring now to FIG. 1 of the drawings, the exemplary fastener setting apparatus, shown mounted on a conventional C-frame 1, has a rivet setting tool 2 that is driven by a linear actuator assembly 3 that in turn is driven by a drive assembly 4. The apparatus is used to insert rivets 5 into a workpiece (not shown but which is typically two or more sheets of material to be joined together) that is placed between the setting tool 2 and a die 6 on the C-frame 1.

The drive assembly 4 comprises an electric motor 10 with a servo-control system. The output shaft 11 of the motor 10 is connected in parallel to the linear actuator assembly 3 via an endless toothed belt 12 and drive pulleys 13,14. The linear actuator assembly 3 converts the rotational motion of the motor output shaft 11 and drive pulleys 13, 14 into a reciprocating linear movement of an elongate output shaft 15 that is connected to a plunger 16 of the rivet setting tool 2.

The setting tool 2 comprises a cylindrical housing 20 in which a clamping tube 21 is concentrically and slidably disposed. A coaxial nose section 22 is attached to the end of the clamping tube 21 and has a rivet delivery passage 23 through which a rivet 5 is guided to the workpiece. The rivet is moved through the delivery passage 23 by a punch 24 that is carried by the plunger 16. The punch 24 and plunger 16 are arranged for reciprocal axial movement within the clamping tube 21 and the delivery passage 23 and are driven by the output shaft 15 of the linear actuator assembly 3.

A stack of disc springs 26 is provided in an annular clearance between the plunger 16 and the clamping tube 21. These springs 26 determine the magnitude of the clamping force that is applied by the nose 22 to the workpiece during the rivet setting operation. At the top of the spring stack, concentric with the plunger 16, is a spring support tube 27 that is received inside the coils at one end of a compression spring 28. The other end of the spring 28 is supported by an annular surface defined on a coupling 29 between the linear actuator output shaft 15 and the plunger 16.

The linear actuator assembly 3 is in the form an internal roller screw that comprises a rotary elongate cylinder 30 with an internally threaded bore 31 along the majority of its length. An input shaft 32 at one end of the cylinder 30 is drivingly connected to the belt drive 12 by a drive pulley 14 and is supported in bearings 33, 34 for rotation. The other end of the cylinder is also supported for rotation by bearings 37.

The output shaft 15 of the linear actuator assembly 3 extends coaxially in the bore 31 of the cylinder 30 and the end distal from the plunger 16 has a plurality of annular grooves 35. Interposed between the threaded bore 31 of the cylinder 30 and the grooved end of the output shaft 15 is a plurality of threaded transmission rollers 36 around the circumference of the grooved end. These couple the cylinder 30 to the output shaft 15 and serve to convert the rotary motion of the former into linear movement of the latter. The output shaft 15 is thus arranged for reciprocal motion relative to the cylinder 30 and any such movement is transmitted directly to the plunger 16 of the rivet setting tool 2. For convenience the combination of the output shaft 15, the plunger 16 and the punch 24 is hereinafter referred to as the actuator assembly.

Figure 2:
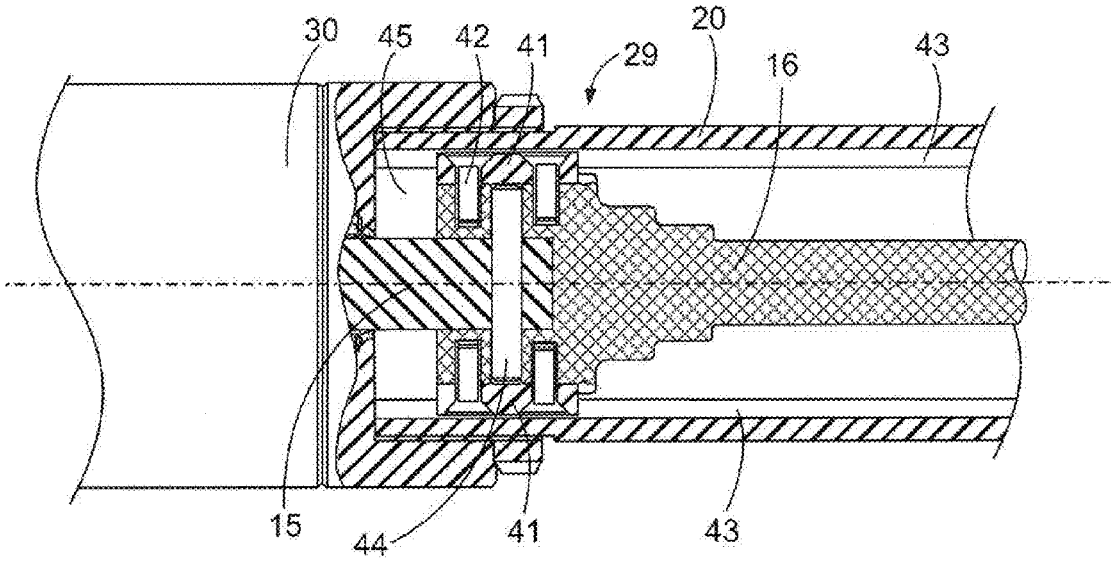
FIG. 2 is a sectioned view of the connection shown in FIG. 3.
Figure 3:
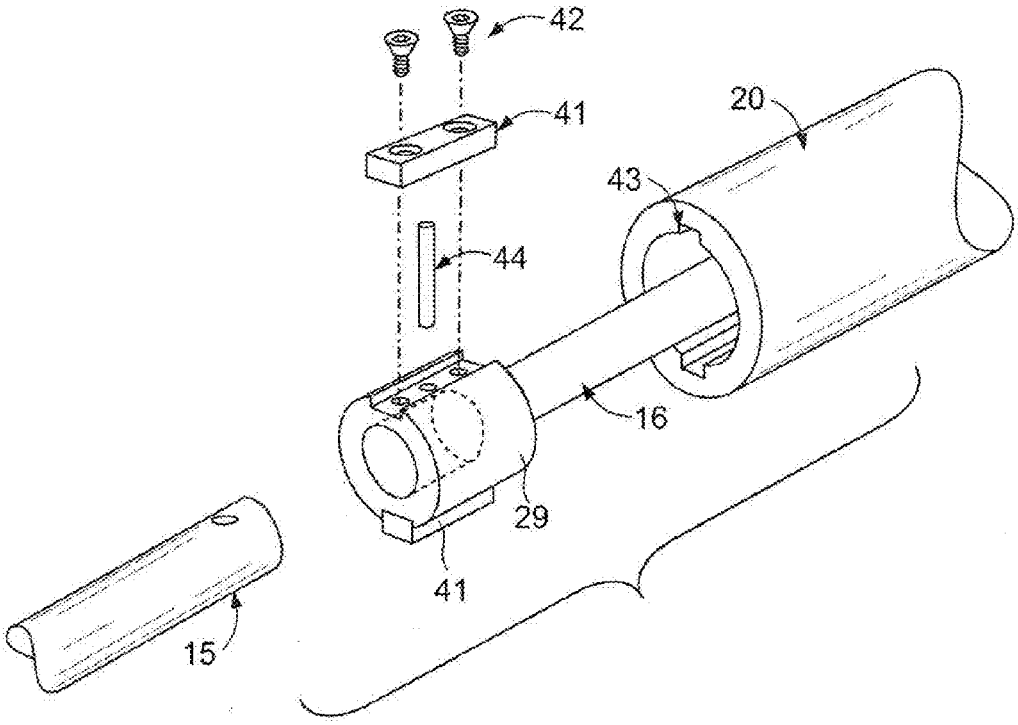
FIG. 3 is a perspective exploded view of a connection between a linear actuator output shaft and plunger forming part of the apparatus of FIG. 1.

Referring now to FIGS. 2 and 3, the output shaft 15 is connected to the plunger 16 by means of the coupling 29 that comprises a generally annular member with coaxial bores at each end designed to receive the ends of the output shaft 15 and the plunger 16 respectively. Reciprocal motion of the output shaft 15 and plunger 16 is supported by a linear bearing in the form of two keys 41 connected by screws 42 at diametrically opposite locations on the annular member of the coupling 40. The keys 41 are slidably received in respective keyways 43 defined in the housing of the rivet setting tool 2. The linear bearing serves to restrain the actuator assembly from rotation. The end of the output shaft 15 is secured in its bore in the coupling 29 by a transverse shear pin 44 that passes through apertures in both. Under normal operating conditions any tendency for the output shaft 15 to rotate whilst it reciprocates in the cylinder 30 and rivet setting tool housing 20 is prevented by virtue of the reaction forces between the keys 41 and keyways 43. Since this tendency to rotate is caused by the frictional forces between the transmission rollers 36 and the annular grooves 35 in the output shaft 15, the magnitude of force involved is relatively small. However if the output shaft 15 should reach the end of its travel in either direction such that the transmission rollers 36 abut an end of the cylinder 30, the torsional forces will increase rapidly if the cylinder 30 continues to rotate. The shear pin 44 is thus designed to fail in shear at a predetermined torque so as to break the connection between the output shaft 15 and plunger 16 thereby preventing damage to the apparatus. The cylinder 30 has integral end stops 45, 46 at each end so as to ensure that the torque is transmitted from the transmission rollers 36 and output shaft 15 to the coupling 29 in the event that the output shaft 15 reaches the end of its travel.

Linear movement of the output shaft 15 out of the cylinder 30 forces the plunger 16 to move relative to the housing 20 of the rivet setting tool 2 and towards the workpiece. This movement is transferred via the coil spring 28 to the clamping tube 21 and nose 22 which advance in the same direction relative to the housing until the end face of the nose contacts the workpiece whereupon the clamping tube 21 is prevented from further advancement. Continued extension of the output shaft 15 then moves the coupling 29, plunger 16 and punch 24 relative to the clamping tube 21 and nose 22 and results in compression of the coil spring 28. The force imparted by the spring 28 to the clamping tube 21 is simply intended to maintain the workpiece in the correct orientation during the riveting operation. The rivet 5 to be inserted is driven through the delivery passage 23 and is brought into contact with the workpiece. Further advancement of the actuator assembly drives the rivet 5 into the workpiece. During rivet insertion the stack of disc springs 26 are compressed thereby applying a significant clamping force to workpiece via the clamping tube 21 and nose 22. The clamping force is thus increased rapidly during rivet insertion until it reaches a maximum when the rivet bead is flush with the surface of the workpiece. Once the rivet has been inserted the direction of rotation of the motor output shaft is reversed so as to reverse the direction of rotation of the cylinder 30 and to retract the actuator assembly ready for the next rivet to be inserted.

As will be explained below, the use of an internal roller screw actuator in combination with an appropriate servo-control system enables a controlled amount of energy to be made available in the insertion of a rivet. This is because an internal roller screw has a rotary cylinder that has a significantly greater polar moment of inertia as compared to an external roller screw and can thus be rotated in the manner of a flywheel to deliver significant energy into a riveted joint without the need for a large drive motor. As an example, tests have established that the method and apparatus of the present invention may be used to insert conventional rivets with a motor having a capacity of 1.6 horse power and at an insertion speed faster than rivets inserted by conventional apparatus using a motor rated at 5 horse power.

The servo-control system comprises the servo-controller for the motor 10, an optical encoder for measuring the angular velocity of the output shaft (other forms of angular velocity sensors may be used) and a processor with memory operating under the control of a suitable computer program. The program operates to issue instructions for the servo-controller to control the speed of rotation of the motor armature in response to velocity feedback signals received from the optical encoder and initial control parameters entered in by the user. The user first enters data relating to the rivet and workpiece (size, material, type of rivet, type of joint etc.), data relating to the spring force in the C-frame (indicative of the amount of deflection of the C-frame during rivet insertion), and data relating to the linear actuator and motor being used. The computer program is configured to calculate from the entered data the energy that is required to insert the rivet into the workpiece to form the desired joint and the angular velocity of the motor output shaft required to ensure that, before commencement of the rivet insertion, the cylinder 30 is brought up to a velocity that will deliver the calculated energy to the riveted joint. The data relating to the linear actuator identifies a particular part number whose physical parameters are stored in a look-up table in the control system memory. The parameters include, for example, the moment of inertia of the cylinder, the thread pitch and the maximum possible stroke length. The data relating to the rivet and the workpiece will include the required stroke distance to insert the rivet and the length of the rivet. The calculation of the required angular velocity of the cylinder is based on the following equation:

$$E=\omega^2 I/2$$

Where:

E is the energy required to insert the rivet,

ω is the angular velocity of the cylinder; and

I is the mass moment of inertia of the cylinder (including the inner races of the supporting bearings, the drive shaft, the drive pulley and the drive motor).

A compensation factor is introduced into the calculations to take into account the efficiency with which the energy is transferred from the cylinder 30 to the punch 24 (energy is lost in friction and heat etc.).

On the assumption that the drive transmission belt 12 and pulleys 13, 14 between the motor 10 and the cylinder input shaft 32 provide a transmission ratio of 1:1 without any efficiency losses, the calculated value of (o is the angular velocity of the motor output shaft 11 necessary to deliver the desired energy. Thus the servo-controller issues signals to accelerate the motor output shaft 11 to that angular velocity and maintain it at that rate. Using a 1:1 transmission ratio with toothed pulleys 13, 14 and toothed drive belt 12 results in close to 100% efficiency but if losses are expected in the transmission account can be taken of them in the calculation.

It will be appreciated that the required energy to insert the fastener and the angular velocity of the cylinder may be determined empirically instead of, or in addition to, calculation.

The initial revolutions of the motor output shaft 11 serve to accelerate the cylinder 30 up to the desired angular velocity whilst the actuator assembly is advanced. The inertia of the cylinder 30 is such that the angular velocity would diminish at a slow rate if left to rotate but the angular velocity is maintained by the servo-controlled motor so that the cylinder 30 always has the required amount of energy to ensure insertion of the rivet when it is contacted by the punch 24. The data relating to the required stroke length of the actuator assembly, the rivet length and the thread pitch of the cylinder 30 enables the processor to determine the number of turns of the cylinder 30 (and therefore motor output shaft 11) that are available to bring it to the calculated angular velocity before the actuator assembly begins rivet insertion. The riveting method thus makes no use of positional feedback to control rivet insertion but rather is designed to maintain the angular velocity of the drive motor and therefore the cylinder 30 until commencement of the rivet insertion. In conventional electrical rivet setters an actuator with a large polar mass moment of inertia is difficult to control in terms of positional accuracy especially if there is a large difference between the polar moments of inertia of the actuator and the drive motor. Attempting to position accurately an actuator that, in use, has significant inertia places large demands on the control system. The present method of maintaining the velocity of the cylinder part of the linear actuator so as to deliver a predetermined amount of energy to the rivet insertion process without relying on positional or force sensors eliminates those control problems.

The displacement of the actuator assembly may be determined from the velocity encoder (displacement being velocity multiplied by time) and plotted against the velocity readings from the same encoder. The rate of deceleration of the motor output shaft to displacement provides process data that can be compared to reference data to determine whether the resulting joint is of the desired quality. This is in contrast to conventional riveting apparatus where force sensors are required to obtain the same result.

When the punch 24 moves the rivet against the workpiece the kinetic energy stored in the rotating cylinder 30 is transferred via the output shaft 15 and the plunger 16 to effect rivet insertion. The insertion process acts as a brake and brings the cylinder 30 to rest its energy is expended as work done in inserting the rivet. If the servo-controller attempts to maintain the angular velocity of the motor output shaft 11 during rivet insertion the torque will also be transferred to the rivet insertion process although this is a relatively small proportion of the overall force applied. This torque will be converted into attempted linear movement of the plunger and the resulting force serves to maintain a clamping force (provided by the clamping tube and disc springs) for a finite period at the end of the rivet insertion. During rivet insertion the limb of the C-frame 1 that supports the die 6 deflects away from the rivet setting tool in response to the insertion forces. Immediately after rivet insertion the C-frame attempts to spring back to its equilibrium position and if allowed to would collide with the rivet setting tool. The clamping force at the end of rivet insertion acts against this reaction force of the C-frame and prevents the actuator assembly from being pushed back unduly. However, the servo-control system is programmed to reverse the motor during the C-frame reaction so that the spring energy is released in a damped motion without a large amount of motor current being used to restrain the C-frame.

In certain applications the motor may be controlled so as to rotate at an angular velocity greater than that required for insertion of the rivet. This may be required when it is necessary for the actuator assembly (i.e. the output shaft 15, the plunger 16 and the punch 24) to traverse a large non-working stroke rapidly so as to reduce the cycle time. In such circumstances the servo-control system operates the motor as a brake to decelerate the cylinder to the required angular velocity just before or even during the rivet insertion process. The same action may be required during rapid retraction of the actuator assembly over a large distance. When acting as a brake the motor serves as a generator and the control system may be designed to store the generated electricity in one or more capacitors for use when the motor is next accelerated.

It will be appreciated that the cylinder design is of paramount importance in the present invention and it is necessary to select the correct design of internal roller screw actuator for the particular fastening application concerned as the energy deliverable to the rivet insertion process by the apparatus is principally dependent on the moment of inertia of the cylinder and the capacity of the motor. It is therefore anticipated that one or more small flywheels (one shown at 50 in FIG. 1) may be provided for optional connection to the drive pulleys or the drive shaft of the cylinder so as to "tune" the apparatus if necessary.

In a variation to the method described above a clamping force may be applied after the rivet has been inserted in accordance with the methods described in our international patent application WO 00/29145.

It will be appreciated that numerous modifications to the above described method and apparatus may be made without departing from the scope of the invention as defined in the appended claims. For example, the method and apparatus of the present invention may be used to insert any appropriate form of fastener into a workpiece where there is resistance to insertion. In addition it may be used in a clinching operation whereby two sheets of material are deformed into locking engagement to form a clinched joint Moreover, the coupling between the output shaft and the plunger 16 may include any form of automatic clutch device that is designed to disengage the connection when the torque in the output shaft exceeds a predetermined magnitude. Finally, it is to be understood that the method of the present invention may be applied to an external roller screw linear actuator as well as an internal roller screw. In the event that an external roller screw is used it is necessary to attach a flywheel of significant size to a screw member of the roller screw.

What is claimed is:

1. A panel clinching method wherein a workpiece including two or more sheets of material are deformed into locking engagement, the deformation resulting from the driving of a punch of fastening apparatus, the sheet material being disposed between a nose and a die of fastening apparatus, in which rotational movement of a longitudinally extending screw member is converted into linear movement of an actuator assembly by intermediate rolling transmission elements disposed between a thread of the screw member and a threaded circumferential surface of the actuator assembly so as to be in rolling contact with both, the screw member being driven in rotation by a drive system, the method comprising the steps of:

(a) determining an energy required to deform the material;

(b) determining a required angular velocity of the screw member to achieve a kinetic energy level of the screw member and drive system that is sufficient to deliver the determined energy to the actuator assembly;

(c) controlling the drive system so as to accelerate the screw member to an angular velocity in excess of the determined angular velocity, the rotation of the screw member effecting simultaneous linear movement of the actuator assembly towards the workpiece; and (d) thereafter controlling the drive system so that it acts as a brake on the screw member thereby decelerating the screw member until it reaches substantially the required angular velocity either before or during a period when the actuator assembly comes into contact with the workpiece so as to transfer the kinetic energy of the rotating screw member into work done in deforming the workpiece.

2. A panel clinching method wherein a workpiece including two or more sheets of material are deformed into locking engagement, the deformation resulting from the driving of a punch of fastening apparatus, the sheet material being disposed between a nose and a die of fastening apparatus, in which rotational movement of a longitudinally extending screw member is converted into translational movement of an actuator assembly by intermediate rolling transmission elements disposed between a thread of the screw member and a threaded circumferential surface of the actuator so as to be in rolling contact with both, the screw member being driven in rotation by a drive system, the method comprising the steps of:

(a) determining an energy required to deform the material;

(b) determining a required angular velocity of the screw member to achieve a kinetic energy level of the screw member and drive system that is sufficient to deliver the determined energy to the actuator assembly;

(c) controlling the drive system so as to accelerate the screw member to an angular velocity in excess of the determined angular velocity, the rotation of the screw member effecting simultaneous translational movement of the actuator assembly towards the workpiece;

(d) determining the deceleration of the rotating drive system or screw member that occurs during deformation of the workpiece; and (e) calculating an insertion force applied from determined deceleration and a mass moment of inertia of the screw member.

3. A panel clinching method wherein a workpiece including two or more sheets of material are deformed into locking engagement, the deformation resulting from the driving of a punch of fastening apparatus, the sheet material being disposed between a nose and a die of fastening apparatus, in which rotational movement of a longitudinally extending screw member is converted into translational movement of an actuator assembly by intermediate rolling transmission elements disposed between a thread of the screw member and a threaded circumferential surface of the actuator so as to be in rolling contact with both, the screw member being driven in rotation by a drive system, the method comprising the steps of:

(a) determining an energy required to deform the material;

(b) determining a required angular velocity of the screw member to achieve a kinetic energy level of the screw member and drive system that is sufficient to deliver the determined energy to the actuator assembly;

(c) controlling the drive system so as to accelerate the screw member to an angular velocity in excess of the determined angular velocity, the rotation of the screw member effecting simultaneous translational movement of the actuator assembly towards the workpiece and causes a jaw of a C-frame supporting the workpiece to deflect; and (d) after deforming the workpiece, reversing the direction of rotation of the drive system so that a reaction force that causes the jaw of the C-frame to spring back from its deflected position is damped.

* * * * *